US008319708B2

(12) United States Patent
Yoo et al.

(10) Patent No.: US 8,319,708 B2
(45) Date of Patent: Nov. 27, 2012

(54) PIXEL AND ORGANIC LIGHT EMITTING DISPLAY DEVICE USING THE SAME

(75) Inventors: Myoung-Hwan Yoo, Yongin (KR); Keum-Nam Kim, Yongin (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 693 days.

(21) Appl. No.: 12/504,896

(22) Filed: Jul. 17, 2009

(65) Prior Publication Data

US 2010/0013806 A1 Jan. 21, 2010

(30) Foreign Application Priority Data

Jul. 21, 2008 (KR) ..... 10-2008-0070608

(51) Int. Cl.
*G09G 3/30* (2006.01)

(52) U.S. Cl. ..... 345/76; 345/77; 345/78; 315/169.3

(58) Field of Classification Search ..... 345/76–83, 345/204–215; 315/169.3
See application file for complete search history.

(56) References Cited

U.S. PATENT DOCUMENTS

| | | | | |
|---|---|---|---|---|
| 2006/0061560 | A1* | 3/2006 | Yamashita et al. | 345/204 |
| 2006/0170628 | A1* | 8/2006 | Yamashita et al. | 345/76 |
| 2007/0115224 | A1* | 5/2007 | Yamamoto et al. | 345/76 |
| 2008/0048955 | A1* | 2/2008 | Yumoto et al. | 345/82 |
| 2008/0198103 | A1* | 8/2008 | Toyomura et al. | 345/77 |
| 2009/0243498 | A1* | 10/2009 | Childs et al. | 315/169.3 |

FOREIGN PATENT DOCUMENTS

| | | | |
|---|---|---|---|
| KR | 1020040107047 | A | 12/2004 |
| KR | 1020050085053 | A | 8/2005 |
| KR | 1020060065168 | A | 6/2006 |
| KR | 1020080003240 | A | 7/2008 |

OTHER PUBLICATIONS

Korean Office Action for Korean Patent Application No. 10-2008-0070608—2 pages, dated Mar. 31, 2010.

* cited by examiner

*Primary Examiner* — Amare Mengistu
*Assistant Examiner* — Gene W Lee
(74) *Attorney, Agent, or Firm* — Knobbe Martens Olson & Bear, LLP

(57) ABSTRACT

A pixel for an organic light emitting diode display is disclosed. The pixel includes a capacitor configured to be charged with a voltage which compensates for the threshold voltage and mobility of the transistor driving the organic light emitting diode of the pixel.

10 Claims, 5 Drawing Sheets

PIXEL AND ORGANIC LIGHT EMITTING DISPLAY DEVICE USING THE SAME

CROSS-REFERENCE TO RELATED APPLICATIONS

This application claims priority to and the benefit of Korean Patent Application No. 10-2008-0070608, filed on Jul. 21, 2008, in the Korean Intellectual Property Office, the entire content of which is incorporated herein by reference.

BACKGROUND

1. Field

The field relates to a pixel and an organic light emitting display device using the same, and more particularly, to a pixel capable of compensating for the threshold voltage and mobility of a driving transistor, and an organic light emitting display device using the same.

2. Description of the Related Technology

Recently, various types of flat panel display devices having less weight and volume than cathode ray tubes have been developed. The flat panel display devices include liquid crystal display devices, field emission display devices, plasma display panels, organic light emitting display devices, and the like.

Of these flat panel display devices, the organic light emitting display device displays images using organic light emitting diodes (OLEDs) that emit light through recombination of electrons and holes. The organic light emitting display device has a fast response speed and is driven with low power consumption.

Generally, an organic light emitting display device expresses a gray level and controls the amount of current that flows into an organic light emitting diode using a driving transistor included in each pixel. In this case, the luminance of different pixels in a displayed image may vary due to the threshold voltage and mobility variations of the driving transistor included in each of the pixels.

In order to solve such a problem, a method has been proposed in Korean Patent Publication No. 10-2007-0112714. In the method, the threshold voltage and mobility of a driving transistor are compensated by changing the electric potential of a first power source supplying current to an organic light emitting diode into a first electric potential (high electric potential) and a second electric potential (low electric potential).

However, when the potential of the first power source, which is a power supply voltage, is changed, a circuit component such as a filter is additionally used. Further, high heat is generated, and therefore, a heat sink is used.

SUMMARY OF CERTAIN INVENTIVE ASPECTS

One aspect is an organic light emitting display device. The device includes a scan driving unit configured to drive scan lines, light-emitting control lines, and control lines. The device also includes a data driving unit configured to supply reference power and data signals to data lines, and a plurality of pixels positioned near intersections of the scan lines and the data lines. Each of the pixels is positioned in a horizontal row include an organic light emitting diode coupled between first power and second power, a first transistor coupled to the first power, where the first transistor is configured to control an amount of current that flows to the organic light emitting diode from the first power. Each of the pixels also include a second transistor coupled between a gate electrode of the first transistor and a data line and configured to be turned on when a scan signal is supplied from a scan line, a third transistor coupled between a source electrode of the first transistor and initialization power and configured to be turned on when a control signal is supplied from a control line, a fourth transistor coupled between the source electrode of the first transistor and the organic light emitting diode, the fourth transistor configured to be turned on when a light-emitting control signal is supplied from a light-emitting control line, and otherwise turned off, and a storage capacitor coupled between the gate and source electrodes of the first transistor.

Another aspect is a pixel including an organic light emitting diode coupled between first power and second power, a first transistor coupled between the first power, where the first transistor is configured to control an amount of current that flows to the organic light emitting diode from the first power. The pixel also includes a second transistor coupled between a gate electrode of the first transistor and a data line, the second transistor including a gate electrode coupled to a scan line, a third transistor coupled between a source electrode of the first transistor and initialization power, the third transistor including a gate electrode coupled to a control line, a fourth transistor coupled between the source electrode of the first transistor and the organic light emitting diode, the fourth transistor including a gate electrode coupled to a light-emitting control line, and a storage capacitor coupled between the gate and source electrodes of the first transistor.

Another aspect is a display including a first pixel, where the first pixel includes an organic light emitting diode, a driving transistor, configured to drive the organic light emitting diode, a storage capacitor, coupled between the gate and source electrodes of the driving transistor, and a plurality of transistors, configured to charge the storage capacitor with a voltage which compensates for the threshold voltage and mobility of the driving transistor.

BRIEF DESCRIPTION OF THE DRAWINGS

The accompanying drawings, together with the specification, illustrate exemplary embodiments.

DETAILED DESCRIPTION OF PREFERRED EMBODIMENTS

Figure 1:
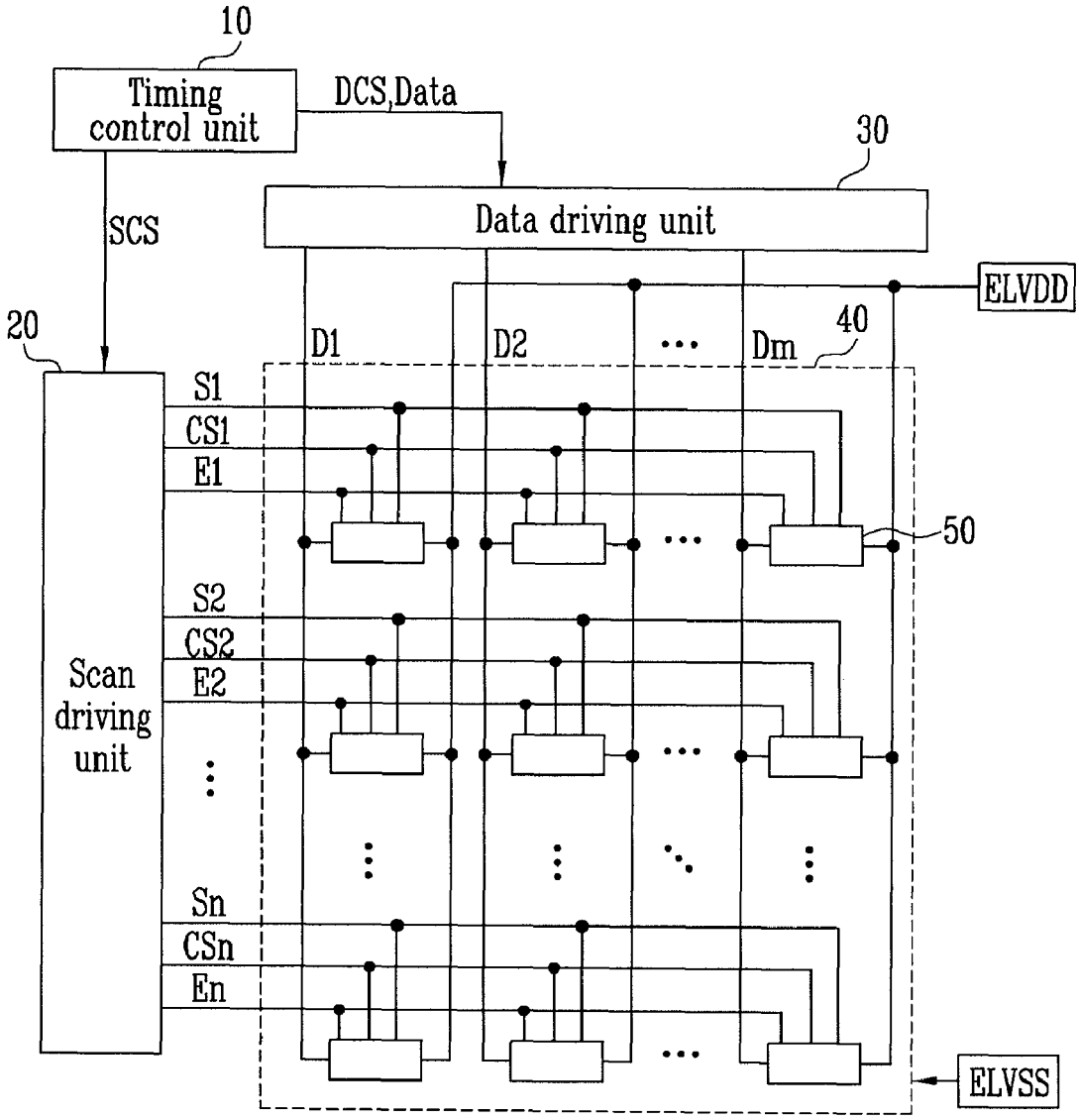
FIG. 1 is a block diagram of an organic light emitting display device according to an embodiment.

Various embodiments provide a pixel capable of compensating for the threshold voltage and mobility of a driving transistor without changing potential of a first power source, and an organic light emitting display device using the same.

Some embodiments provide an organic light emitting display device, which includes: a scan driving unit driving scan lines, light-emitting control lines and control lines; a data driving unit supplying reference power and data signals to data lines; and pixels positioned at intersection portions of the scan lines and the data lines, wherein each of the pixels positioned in an i-th (i is a natural number) horizontal line includes: an organic light emitting diode coupled between first power and second power; a first transistor coupled to the first power and the organic light emitting diode to control an amount of current that flows to the organic light emitting diode from the first power; a second transistor coupled between a gate electrode of the first transistor and a data line, and turned on when a scan signal is supplied from an i-th scan line; a third transistor coupled between a source electrode of the first transistor and initialization power, and turned on when a control signal is supplied from an i-th control line; a fourth transistor coupled between the source electrode of the first transistor and the organic light emitting diode, turned on when a light-emitting control signal is supplied from an i-th light-emitting control line, and otherwise turned off; and a storage capacitor coupled between the gate and source electrodes of the first transistor.

Here, the scan driving unit may supply a scan signal to the i-th scan line during first to third periods, supply a control signal to the i-th control line during the first period, and supply a light-emitting control signal to the i-th light-emitting control line during the first and second periods. The data driving unit may supply the reference power to the data lines during the first and second periods, and supply the data signals to the data lines during the third period when the potential of the light-emitting control signal is transferred.

The potential of the reference power may be set higher by the threshold voltage of the first transistor than that of the initialization power.

The potential of the first power may be set higher than that of the reference power.

The initialization power source may be set as the second power.

Some embodiments provide a pixel which includes: an organic light emitting diode coupled between first power and second power; a first transistor coupled between the first power and the organic light emitting diode to control an amount of current that flows to the organic light emitting diode from the first power; a second transistor coupled between a gate electrode of the first transistor and a data line and having a gate electrode coupled to a scan line; a third transistor coupled between a source electrode of the first transistor and initialization power and having a gate electrode coupled to a control line; a fourth transistor coupled between the source electrode of the first transistor and the organic light emitting diode and having a gate electrode coupled to a light-emitting control line; and a storage capacitor coupled between the gate and source electrodes of the first transistor.

Here, the second transistor may be turned on during first to third periods, and the third and fourth transistors may be turned on in the first and third periods, respectively.

The first to fourth transistors may be N-type transistors.

In a pixel and an organic light emitting display device using the same, the threshold voltage and mobility of a driving transistor can be compensated while allowing the potential of first power to be constantly maintained. Hereinafter, certain exemplary embodiments will be described with reference to the accompanying drawings. When a first element is described as being coupled to a second element, the first element may be not only directly coupled to the second element but may also be indirectly coupled to the second element via a third element. Further, some of the elements that are not essential to the complete understanding of the invention may be omitted for clarity. Also, like reference numerals generally refer to like elements throughout. The embodiments discussed include various signals having high and low values. One of skill in the art will understand that inverse values may be used with appropriate circuit changes without departing from the inventive aspects of the embodiments.

FIG. 1 is a block diagram of an organic light emitting display device according to one embodiment.

Referring to FIG. 1, the organic light emitting display device includes a timing control unit 10, a scan driving unit 20, a data driving unit 30, and a pixel unit 30.

The timing control unit 10 generates a scan driving control signal SCS and a data driving control signal DCS, corresponding to synchronization signals received from either inside or from outside the organic light emitting display device. The scan driving control signal SCS generated in the timing control unit 10 is supplied to the scan driving unit 20, and the data driving control signal DCS generated in the timing control unit 10 is supplied to the data driving unit 30. The timing control unit 10 supplies data signal Data supplied from either inside or from outside the organic light emitting display device to the data driving unit 30.

The scan driving unit 20 drives scan lines S1 to Sn, control lines CS1 to CSn, and light-emitting control lines E1 to En. To this end, the scan driving unit 20 sequentially selects pixels 50 for each row while sequentially supplying a scan signal of a high level to the scan lines S1 to Sn. The scan driving unit 20 sequentially supplies a control signal of a high level to the control lines CS1 to CSn, and sequentially supplies a light-emitting control signal of a low level to the light-emitting control lines E1 to En.

However, when driving pixels 50 positioned in an i-th (i is a natural number) horizontal line, the scan driving unit 20 of this embodiment supplies a control signal to an i-th control line CSi and supplies a light-emitting control signal to an i-th light-emitting control line Ei within a period when a scan signal is supplied to an i-th scan line Si. The scan driving unit 20 suspends the light-emitting control signal after a time elapses from the time when the control signal is suspended. The suspension of the light-emitting control signal means that the potential (voltage level) of the light-emitting control signal is changed.

Figure 3:
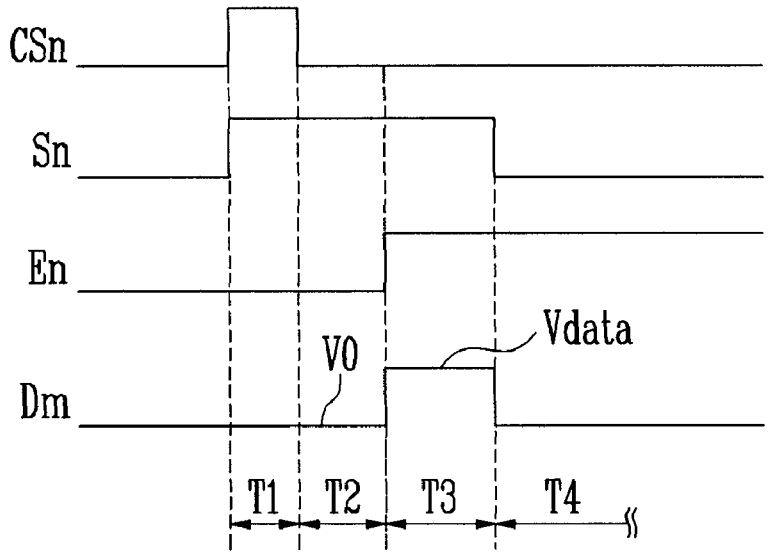
FIG. 3 is a waveform diagram illustrating a method of driving the pixel shown in FIG. 2.

For example, as shown in FIG. 3, while the scan driving unit 20 supplies a scan signal of a high level to an n-th scan line Sn during first to third periods T1 to T3, the scan driving unit 20 supplies a control signal of a high level to an n-th control line CSn during only the first period T1 and supplies a light-emitting control signal of a low level to an n-th light-emitting control line En during the first and second periods T1 and T2. The potential of the light-emitting control signal is set as a high potential from the third period T3 when the supply of the light-emitting control signal is suspended.

Here, the first period T1 is a period when a driving transistor provided in the pixel 50 is initialized, and the second period T2 is a period when the threshold voltage of the driving transistor is compensated. The third period T3 is a period when a voltage corresponding to a data signal is charged.

The data driving unit 30 drives data lines D1 to Dm while supplying reference power and data signals to the data lines D1 to Dm.

For example, as shown in FIG. 3, the data driving unit 30 supplies reference power V0 to the data lines D1 to Dm during the first and second periods T1 and T2, while the scan signal is supplied. The data driving unit 30 supplies a data signal Vdata to the data lines D1 to Dm during the third period T3, after the potential of the light-emitting control signal is changed. In this embodiment, the potential of the reference power V0 is set higher than that of initialization power Vinit shown in FIG. 2. For example, the potential of the reference power V0 may be set as ground potential GND, and the potential of the initialization power Vinit may be set lower than the potential of the reference power V0 by, for example, at least the threshold voltage of a driving transistor (a first transistor M1 of FIG. 2).

The pixel unit 40 includes a plurality of pixels 50 positioned near intersection portions of the scan lines S1 to Sn, the light-emitting control lines E1 to En, the control lines CS1 to CSn, and the data lines D1 to Dm.

Each of the pixels 50 is coupled to a scan line S, a light-emitting control line E, a control line CS, and a data line D, and receives a scan signal, a light-emitting control signal, a control signal and a data signal (or reference power), respectively supplied therefrom. The pixels 50 receive first power ELVDD and second power ELVSS. The pixels 50 emit light having a luminance corresponding to a data signal supplied while the scan signal is supplied.

Figure 2:
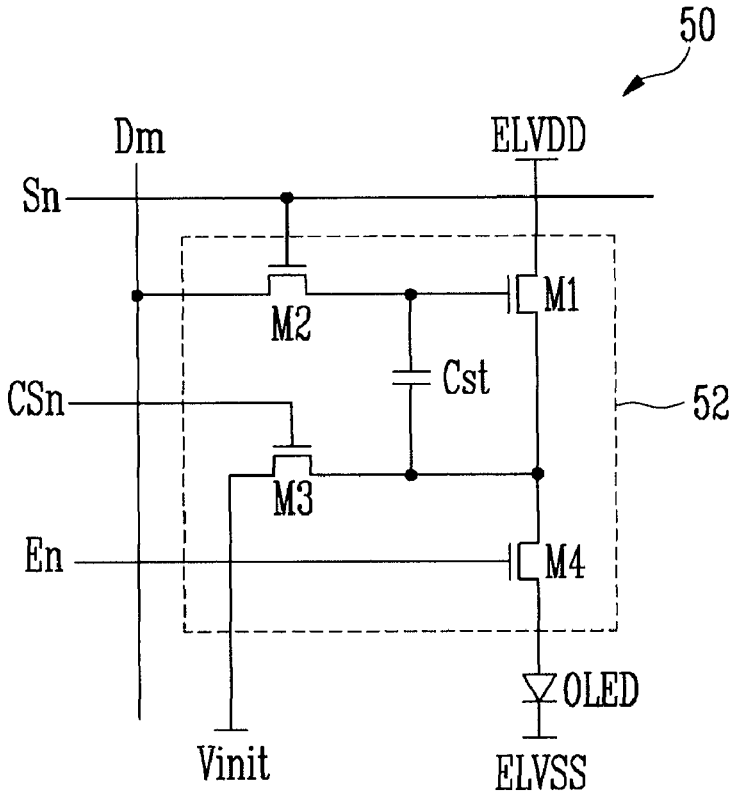
FIG. 2 is a circuit diagram showing an embodiment of a pixel shown in FIG. 1.

FIG. 2 is a circuit diagram showing an embodiment of a pixel shown in FIG. 1. The pixel shown in FIG. 2 is configured with only N-type transistors (e.g., NMOS). Other embodiments use one or more P-type transistors (e.g., PMOS).

Referring to FIG. 2, the pixel 50 includes an organic light emitting diode OLED coupled between the first power ELVDD and the second power ELVSS, and a pixel circuit 52 coupled between the first power ELVDD and the organic light emitting diode OLED to control the organic light emitting diode OLED.

More specifically, the organic light emitting diode OLED is coupled between the pixel circuit 52 and the second power ELVSS. The organic light emitting diode OLED emits light having a luminance corresponding to current supplied from the pixel circuit 52.

The pixel circuit 52 includes first to fourth transistors M1 to M4 and a storage capacitor Cst.

The first transistor M1 (driving transistor) is coupled between the first power ELVDD and the organic light emitting diode OLED. A gate electrode of the first transistor M1 is coupled to the storage capacitor Cst. The first transistor M1 controls an amount of current that flows into the second power ELVSS via the organic light emitting diode OLED from the first power ELVDD, according to the voltage stored in the storage capacitor Cst. The organic light emitting diode OLED emits light having a luminance corresponding to the amount of current from the first transistor M1.

The second transistor M2 is coupled between the gate electrode of the first transistor M1 and the data line Dm. A gate electrode of the second transistor M2 is coupled to the scan line Sn. When a scan signal is supplied to the scan line Sn, the second transistor M2 is turned on to supply reference power V0 and a data signal Vdata supplied from the data line Dm to the storage capacitor Cst.

The third transistor M3 is coupled between a source electrode of the first transistor M1 and the initialization power Vinit. A gate electrode of the third transistor M3 is coupled to the control line CSn. When a control signal is supplied from the control line CSn, the third transistor M3 is turned on to supply the initialization power Vinit to the source electrode of the first transistor M1.

The fourth transistor M4 is coupled between the source electrode of the first transistor M1 and the organic light emitting diode OLED. A gate electrode of the fourth transistor M4 is coupled to the light-emitting control line En. When a low level light-emitting control signal is supplied from the light-emitting control line En, the fourth transistor M4 is turned off. When a high level light-emitting control signal is supplied from the light-emitting control line En, i.e., when the potential of the light-emitting control signal is changed from a low potential to a high potential, the fourth transistor M4 is turned on.

The storage capacitor Cst is coupled between the gate electrode of the first transistor M1 and the source electrode of the first transistor M1. The storage capacitor Cst is charged with a voltage corresponding to the threshold voltage of the first transistor M1 and data signal Vdata.

Although the third transistor M3 is provided in the pixel 50 of this embodiment, other embodiments do not have the third transistor M3. For example, a plurality of pixels positioned in the same horizontal line may share one common third transistor M3.

FIG. 3 is a waveform diagram illustrating a method of driving the pixel shown in FIG. 2. FIGS. 4A to 4D are effective circuit diagrams illustrating a process of driving the pixel shown in FIG. 2.

An operation of the pixel 50 will be described in detail with reference to FIGS. 2, 3 and 4A to 4D. The second transistor M2 is turned on by a scan signal supplied from the scan line Sn during the first to third periods T1 to T3.

The third transistor M3 is turned on by a control signal supplied from the control line CSn during the first period T1.

Figure 4A:
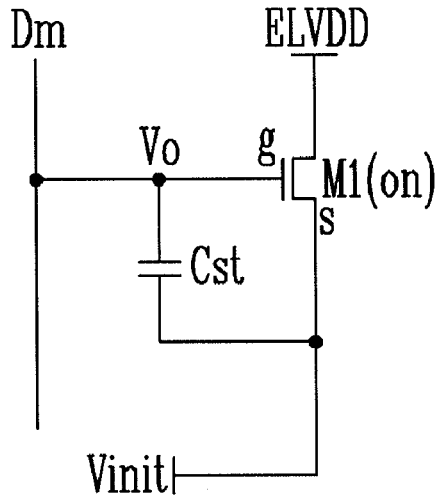
FIGS. 4A to 4D are circuit diagrams illustrating a process of driving the pixel shown in FIG. 2.

As shown in the effective circuit of FIG. 4A, the reference power V0 supplied from the data line Dm by the second transistor M2 is supplied to the gate electrode of the first transistor M1 during the first period T1. Initialization power Vinit is supplied to the source electrode of the first transistor M1 by the third transistor M3. The potential of the reference power V0 is set higher than the potential of the initialization power Vinit by at least the threshold voltage Vth of the first transistor M1. The potential of first power ELVDD is set higher than that of the reference power V0. For example, the potential of the reference voltage V0 may be set as a ground potential GND, and the potential of the initialization power Vinit may be set to be −Vth or less. For this embodiment, the potential of the reference voltage V0 is set as ground power GND. Therefore, the first transistor M1 is turned on and initialized by the reference power V0 and the initialization power Vinit.

In some embodiments, the time of supplying the control signal is identical to that of supplying the scan signal. However, in other embodiments the times are different. For example, in some embodiments, the time of starting the scan signal may be set later than that of starting the control signal, so that the overlapping period of the scan and control signals is decreased. casein such embodiments, the current consumption of the pixel 50 can be reduced.

During the second period T2, the control signal is suspended so that the third transistor M3 is turned off.

Figure 4B:
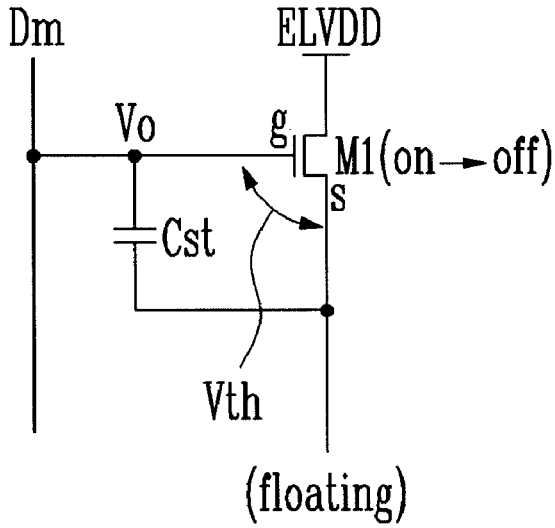

Once the third transistor M3 is turned off, the source electrode of the first transistor M1 and one electrode of the storage capacitor Cst are in a floating state as shown in FIG. 4B.

In the beginning of the second period T2, the first transistor M1 maintains a tuned-on state as in the first period T1. Accordingly, the potential at the source electrode of the first transistor M1 gradually increases. If the voltage (hereinafter, referred to as "Vgs") between the gate and source electrodes of the first transistor M1 is equal to the threshold voltage Vth of the first transistor M1, the first transistor M1 is turns off. That is, the first transistor M1 is turned off when the Vgs of the first transistor M1 is equal to the threshold voltage Vth. Accordingly, the threshold voltage Vth of the first transistor M1 is charged into the storage capacitor Cst.

The fourth transistor M4 maintains a turned-off state by a light-emitting control signal supplied from the light-emitting control line En during the first and second periods T1 and T2. Therefore, the storage capacitor Cst can be stably charged with the threshold voltage Vth of the first transistor M1 during the second period T2.

Figure 4C:
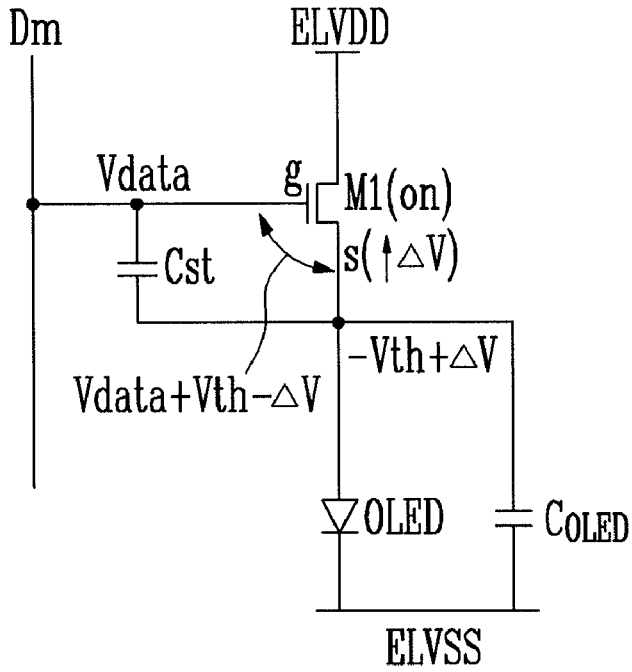

During the third period T3, a data signal Vdata is supplied from the data line Dm so that the voltage of the gate electrode of the first transistor M1 rises to the data signal (data voltage) Vdata, as shown in FIG. 4C. The light-emitting control signal supplied to the light-emitting control line En is suspended so that the fourth transistor M4 is turned on. Accordingly, the organic light emitting diode OLED is coupled to the first transistor M1.

In an initial state of the third period T3, the organic light emitting diode OLED is maintained in a turned-off state. In this case, driving current supplied from the first transistor M1 flows to a parasitic capacitor $C_{OLED}$ of the organic light emitting diode OLED.

The voltage at the source electrode of the first transistor M1 is gradually increased, and therefore the Vgs of the first transistor M1 becomes Vdata+Vth−ΔV. Here, the ΔV is a voltage determined by the data signal Vdata and mobility. Practically, when the data signal Vdata is maintained to be constant, the absolute value of the ΔV increases as the mobility is higher. The value of the −ΔV stored in the storage capacitor Cst compensates for the mobility of each of the pixels 50, and accordingly an image having a uniform luminance can be displayed without influence of the mobility.

After the voltage of Vdata+Vth−ΔV is stored in the storage capacitor Cst, the scan signal is suspended. Accordingly, the second transistor M2 is turned off. The time of suspending the scan signal is experimentally determined so that the voltage of substantially Vdata+Vth−ΔV can be stored in the storage capacitor Cst. Accordingly, the second transistor M2 and the third transistor M3 provide a portion of a compensation circuit, configured to charge the storage capacitor with a voltage which compensates for the threshold voltage and mobility of the driving transistor.

Figure 4D:
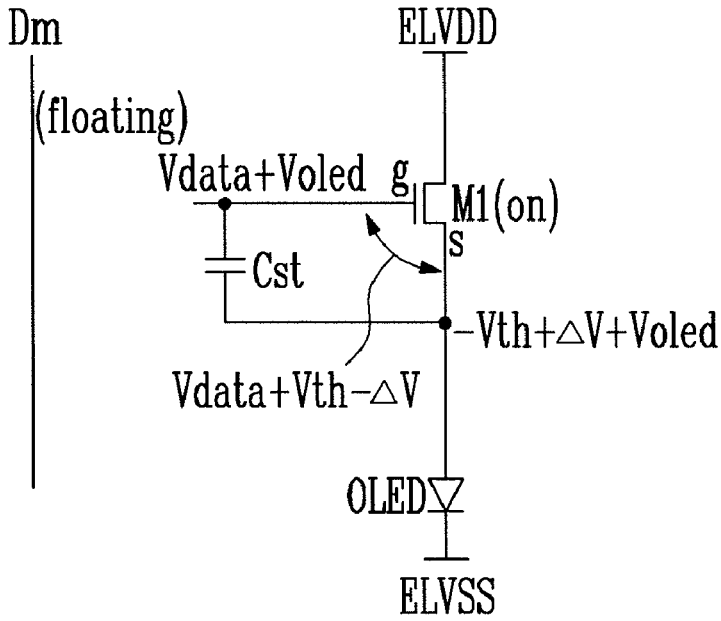

When the second transistor M2 is turned off, the gate electrode of the first transistor M1 is set in a floating state as shown in FIG. 4D. Therefore, by the driving current of the first transistor M1, the storage capacitor Cst stably maintains the voltage charged in the previous period regardless of the voltage $V_{oled}$ applied to the organic light emitting diode OLED.

Figure 5:
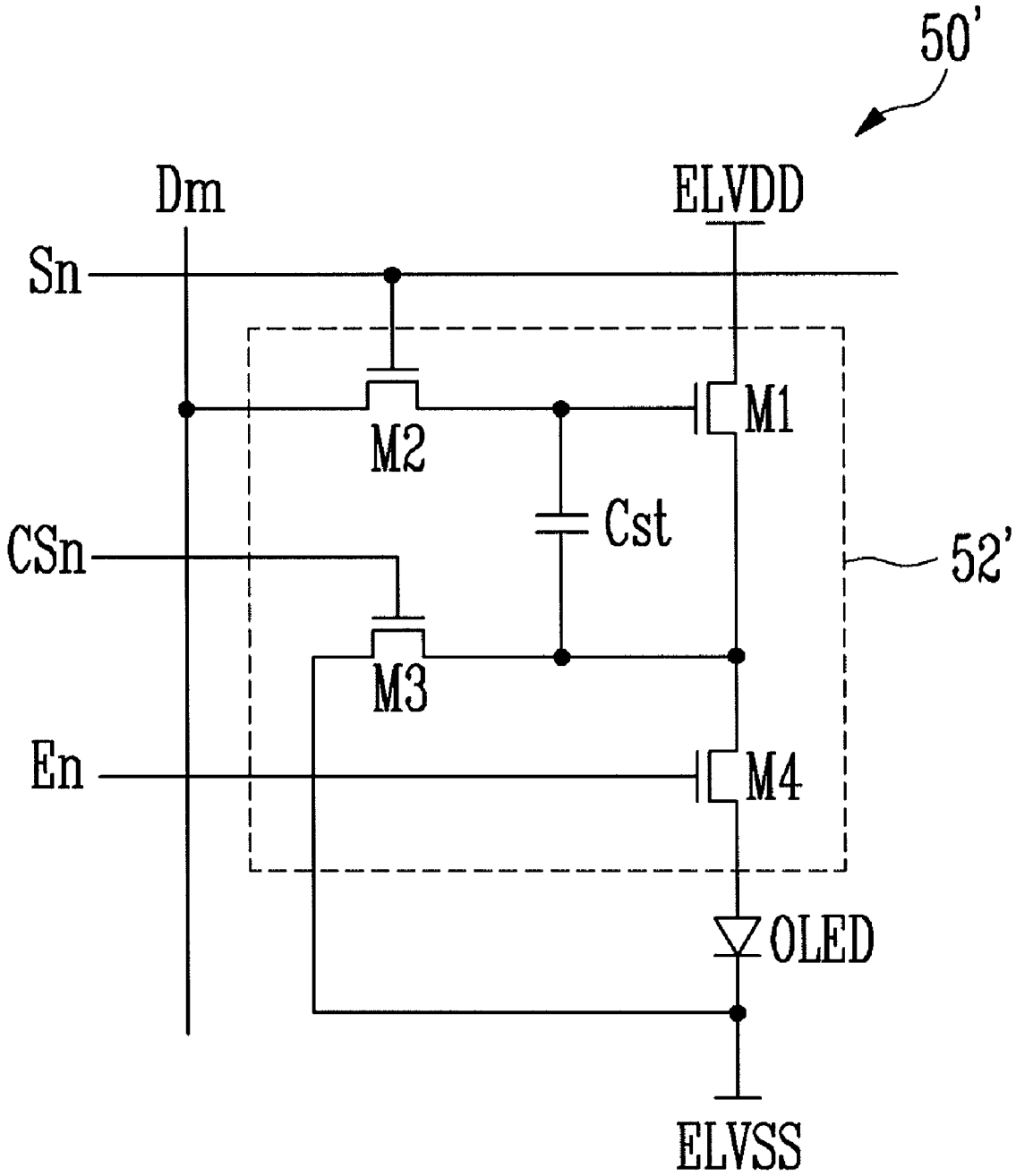
FIG. 5 is a circuit diagram showing another embodiment of a pixel shown in FIG. 1.

FIG. 5 is a circuit diagram showing another embodiment of a pixel shown in FIG. 1. Certain elements of the embodiment of FIG. 5 are substantially identical to those of the embodiment of FIG. 2.

Referring to FIG. 5, in a pixel 50' the third transistor M3 included in a pixel circuit 52' is coupled to second power ELVSS instead of the initialization power Vinit in FIG. 2.

That is, in the pixel 50' shown in FIG. 5, the initialization power Vinit is set as the second power ELVSS, and the potential of the second power ELVSS is set lower than the potential of reference power V0 by at least the threshold voltage Vth of a first transistor M1. In this case, the number of power sources necessary for driving the pixel 50' can be decreased.

The pixel 50' may be driven in the same manner as the pixel 50 shown in FIG. 2.

While the present invention has been described in connection with certain exemplary embodiments, it is to be understood that the invention is not limited to the disclosed embodiments, but, on the contrary, is intended to cover various modifications and equivalent arrangements.

What is claimed is:

1. An organic light emitting display device, comprising:

a scan driving unit configured to drive scan lines, light-emitting control lines, and control lines;

a data driving unit configured to supply reference power and data signals to data lines; and a plurality of pixels positioned near intersections of the scan lines and the data lines, each of the pixels positioned in horizontal row comprising:

an organic light emitting diode coupled between first power and second power;

a first transistor coupled to the first power, the first transistor configured to control an amount of current that flows to the organic light emitting diode from the first power;

a second transistor coupled between a gate electrode of the first transistor and a data line, and configured to be turned on when a scan signal is supplied from a scan line;

a third transistor coupled between a source electrode of the first transistor and initialization power, and configured to be turned on when a control signal is supplied from a control line;

a fourth transistor coupled between the source electrode of the first transistor and the organic light emitting diode, the fourth transistor configured to be turned on when a light-emitting control signal is supplied from a light-emitting control line, and otherwise turned off; and a storage capacitor coupled between the gate and source electrodes of the first transistor.

2. The organic light emitting display device as claimed in claim 1, wherein the scan driving unit is configured to supply a scan signal to the scan line during first, second and third periods, is configured to supply a control signal to the control line during the first period, and is configured to supply a light-emitting control signal to the light-emitting control line during the first and second periods.

3. The organic light emitting display device as claimed in claim 2, wherein the data driving unit is configured to supply the reference power to the data lines during the first and second periods, and is configured to supply the data signals to the data lines during the third period.

4. The organic light emitting display device as claimed in claim 1, wherein the potential of the reference power is set higher than the potential of the initialization power by at least the threshold voltage of the first transistor.

5. The organic light emitting display device as claimed in claim 1, wherein the potential of the first power is set higher than that of the reference power.

6. The organic light emitting display device as claimed in claim 1, wherein the initialization power is set as the second power.

7. A pixel comprising:

an organic light emitting diode coupled between first power and second power;

a first transistor coupled between the first power, the first transistor configured to control an amount of current that flows to the organic light emitting diode from the first power;

a second transistor coupled between a gate electrode of the first transistor and a data line, the second transistor comprising a gate electrode coupled to a scan line;

a third transistor coupled between a source electrode of the first transistor and initialization power, the third transistor comprising a gate electrode coupled to a control line;

a fourth transistor coupled between the source electrode of the first transistor and the organic light emitting diode the fourth transistor comprising a gate electrode coupled to a light-emitting control line; and a storage capacitor coupled between the gate and source electrodes of the first transistor.

8. The organic light emitting display device as claimed in claim 7, wherein the second transistor is configured to be turned on during first, second and third periods, and the third and fourth transistors are configured to be turned on during the first and third periods, respectively.

9. The organic light emitting display device as claimed in claim 7, wherein the first and fourth transistors are N-type transistors.

10. The organic light emitting display device as claimed in claim 7, wherein the initialization power is set as the second power.

* * * * *

US008319708C1

(12) EX PARTE REEXAMINATION CERTIFICATE (47th)

Ex Parte Reexamination Ordered under 35 U.S.C. 257

United States Patent
Yoo et al.

(10) Number: US 8,319,708 C1
(45) Certificate Issued: Dec. 17, 2015

(54) PIXEL AND ORGANIC LIGHT EMITTING DISPLAY DEVICE USING THE SAME

(75) Inventors: Myoung-Hwan Yoo, Yongin (KR); Keum-Nam Kim, Yongin (KR)

(73) Assignee: SAMSUNG DISPLAY CO., LTD.

Supplemental Examination Request:
No. 96/000,093, May 12, 2015

Reexamination Certificate for:

| | |
|---|---|
| Patent No.: | **8,319,708** |
| Issued: | **Nov. 27, 2012** |
| Appl. No.: | **12/504,896** |
| Filed: | **Jul. 17, 2009** |

(30) Foreign Application Priority Data

Jul. 21, 2008 (KR) ..... 10-2008-0070608

(51) Int. Cl.
*G09G 3/30* (2006.01)
*G09G 3/32* (2006.01)

(52) U.S. Cl.
CPC ..... *G09G 3/3233* (2013.01); *G09G 2300/0819* (2013.01); *G09G 2300/0842* (2013.01); *G09G 2300/0861* (2013.01); *G09G 2320/043* (2013.01)

(58) Field of Classification Search
None
See application file for complete search history.

(56) References Cited

To view the complete listing of prior art documents cited during the supplemental examination proceeding and the resulting reexamination proceeding for Control Number 96/000,093, please refer to the USPTO's public Patent Application Information Retrieval (PAIR) system under the Display References tab.

*Primary Examiner* — Cameron Saadat

(57) ABSTRACT

A pixel for an organic light emitting diode display is disclosed. The pixel includes a capacitor configured to be charged with a voltage which compensates for the threshold voltage and mobility of the transistor driving the organic light emitting diode of the pixel.

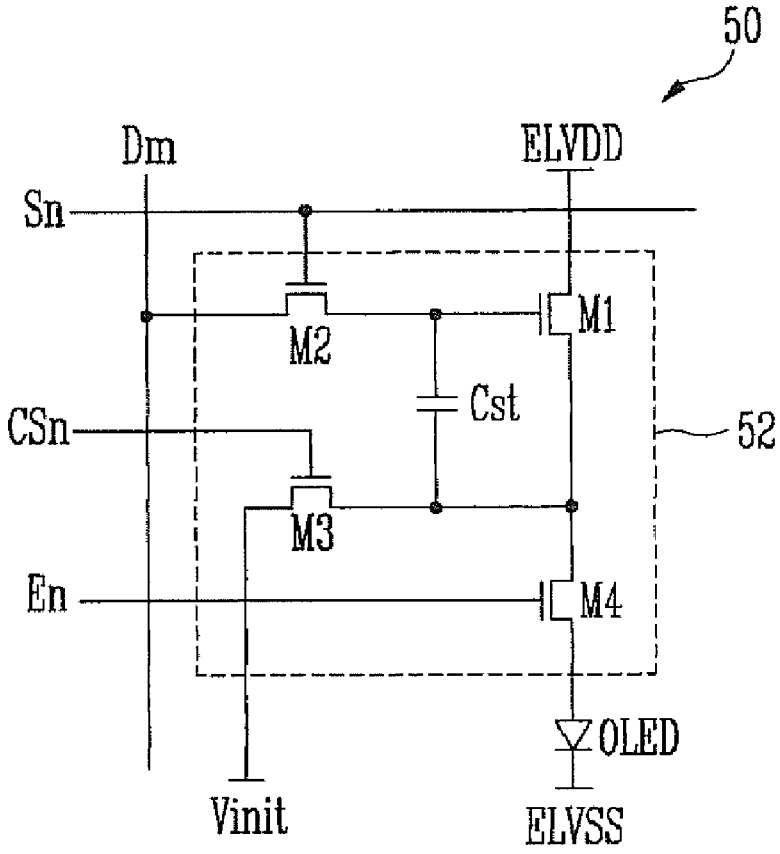

EX PARTE REEXAMINATION CERTIFICATE

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 7-10 are determined to be patentable as amended.

Claims 2-6, dependent on an amended claim, are determined to be patentable.

New claims 11-12 are added and determined to be patentable.

1. An organic light emitting display device, comprising:

a scan driving unit configured to drive scan lines, light-emitting control lines, and control lines;

a data driving unit configured to supply reference power and data signals to data lines; and a plurality of pixels positioned near intersections of the scan lines and the data lines, each of the pixels positioned in horizontal row comprising:

an organic light emitting diode coupled between first power and second power;

a first transistor *directly* coupled to the first power, the first transistor configured to control an amount of current that flows to the organic light emitting diode from the first power;

a second transistor coupled between a gate electrode of the first transistor and a data line, and configured to be turned on [when] *in response to* a scan signal [is] supplied from a scan line;

a third transistor coupled between a source electrode of the first transistor and initialization power, and configured to be turned on [when] *in response to* a control signal [is] supplied from a control line;

a fourth transistor coupled between the source electrode of the first transistor and the organic light emitting diode, the fourth transistor configured to be turned on [when] *in response to* a light-emitting control signal [is] supplied from a light-emitting control line, and otherwise turned off; and a storage capacitor coupled between the gate and source electrodes of the first transistor, *wherein the storage capacitor is directly coupled to all of the first, second, third and fourth transistors*.

7. A pixel comprising:

an organic light emitting diode coupled between first power and second power;

a first transistor *directly* coupled [between] *to* the first power, the first transistor configured to control an amount of current that flows to the organic light emitting diode from the first power;

a second transistor coupled between a gate electrode of the first transistor and a data line, the second transistor comprising a gate electrode coupled to a scan line;

a third transistor coupled between a source electrode of the first transistor and initialization power, the third transistor comprising a gate electrode coupled to a control line;

a fourth transistor coupled between the source electrode of the first transistor and the organic light emitting diode the fourth transistor comprising a gate electrode coupled to a light-emitting control line; and a storage capacitor coupled between the gate and source electrodes of the first transistor, *wherein the storage capacitor is directly coupled to all of the first, second, third and fourth transistors*.

8. The [organic light emitting display device] *pixel* as claimed in claim 7, wherein the second transistor is configured to be turned on during first, second and third periods, and the third and fourth transistors are configured to be turned on during the first and third periods, respectively.

9. The [organic light emitting display device] *pixel* as claimed in claim 7, wherein the first and fourth transistors are N-type transistors.

10. The [organic light emitting display device] *pixel* as claimed in claim 7, wherein the initialization power is set as the second power.

*11. The organic light emitting display device as claimed in claim 1, wherein a first terminal of the storage capacitor is directly coupled to the gate electrode of the first transistor, and wherein a second terminal of the storage capacitor is directly coupled to the source electrode of the first transistor and a drain electrode of the fourth transistor.*

*12. The pixel as claimed in claim 7, wherein a first terminal of the storage capacitor is directly coupled to the gate electrode of the first transistor, and wherein a second terminal of the storage capacitor is directly coupled to the source electrode of the first transistor and a drain electrode of the fourth transistor.*

* * * * *